US005154355A

United States Patent [19]

Gonzalez

[11] Patent Number: 5,154,355

[45] Date of Patent: Oct. 13, 1992

[54] FLOW BOOSTER APPARATUS

[75] Inventor: Teodoro J. Gonzalez, Canyon Country, Calif.

[73] Assignee: Emhart Inc., Newark, Del.

[21] Appl. No.: 738,372

[22] Filed: Jul. 31, 1991

Related U.S. Application Data

[63] Continuation of Ser. No. 79,718, Jul. 30, 1987, Pat. No. 5,111,994.

[51] Int. Cl.[5] ..... E03C 1/08

[52] U.S. Cl. ..... 239/428.5; 239/425.5

[58] Field of Search ..... 239/428.5, 574, 590, 239/581.1, 425.5; 261/DIG. 22

[56] References Cited

U.S. PATENT DOCUMENTS

| | | | |
|---|---|---|---|
| 1,454,280 | 5/1923 | Henrikson | 239/581.1 |
| 2,529,223 | 11/1950 | Moen | 239/428.5 |
| 2,950,063 | 8/1960 | Ripley, Jr. | 239/581.1 |
| 3,322,352 | 5/1967 | Alcantara | 239/428.5 |
| 3,524,591 | 8/1970 | Samuels et al. | 239/428.5 |
| 3,884,418 | 5/1975 | Ritzenthaler | 239/428.5 |
| 4,134,548 | 1/1979 | Harmony | 239/428.5 |
| 4,573,639 | 3/1986 | Logue | 239/428.5 |

FOREIGN PATENT DOCUMENTS

| | | | |
|---|---|---|---|
| 192857 | 12/1937 | Belgium | 239/428.5 |

*Primary Examiner*—Andres Kashnikow
*Assistant Examiner*—Christopher G. Trainor
*Attorney, Agent, or Firm*—J. Bruce Hoffnagle

[57] ABSTRACT

An apparatus for boosting the flow energy of water in a showerhead comprising an air inlet port for providing ambient air; a water conduit for receiving water from a water supply source and at least one mixing chamber being in fluid communication with the water conduit and the air inlet port for receiving the water and the air. The at least one mixing chamber has a rearward opening which tapers towards a forward reduced portion such that the velocity of the water entering the opening is increased and such that the air is mixed with the water within the chamber to provide a turbulent mixture of air and water. The above described apparatus is completely contained within a showerhead or embodied as an adapter unit which may be installed between a water outlet pipe and a typical prior art showerhead.

20 Claims, 3 Drawing Sheets

FLOW BOOSTER APPARATUS

This application is a continuation of application Ser. No. 07/079,718, filed Jul. 30, 1987 now U.S. Pat. No. 5,111,994.

FIELD OF THE INVENTION

The present invention relates to showerheads, and more particularly to an apparatus for increasing the velocity of the water outflowing from the showerhead while at the same time conserving water and maintaining an effective spray.

ART BACKGROUND

Over the years, due to increasing shortages of water, a need has arisen for a showerhead that can deliver an effective spray at a low flow rate. Recently, certain governmental and plumbing code agencies have inacted regulations for conserving water which sets maximum limits on the flow rate of showerheads For example, in the state of California, the California Energy Commission requires that showerheads have a maximum flow rate of 3 gallons per minute ("gpm") at 20 to 80 psi. At a flow rate of 3 gpm or less, the spray pattern of prior art showerheads typically become inefficient producing poor spray patterns.

SUMMARY OF THE INVENTION

The afore-mentioned problems and obstacles found in the prior art showerheads are eliminated by an apparatus for boosting the flow energy within the showerhead. The apparatus comprises: an air inlet port for providing ambient air; a water conduit for receiving water from a water supply source and at least one mixing chamber in fluid communication for mixing water and the ambient air. At least one mixing chamber is in fluid communication with the water supply source and the air inlet port and has a rearward opening which tapers towards a forward reduced portion such that the velocity of the water entering the opening is increased and such that the air is mixed with the water within the chamber to provide a turbulent mixture of air and water.

The above described apparatus may be completely contained within a showerhead, thereby providing a showerhead which provides an effective spray pattern at low volumetric flow rates, i.e. at 3 gpm, the apparatus also boosts the energy of the spray by increasing the velocity of the water which is mixed with air, thereby reducing the amount of water required to achieve an effective spray.

The apparatus of the present invention may also be embodied as an adapter unit which may be installed between a water outlet pipe and a typical prior art showerhead, thereby providing such prior art showerheads with an improved spray.

DETAILED DESCRIPTION OF THE PRESENT INVENTION

Figure 1:
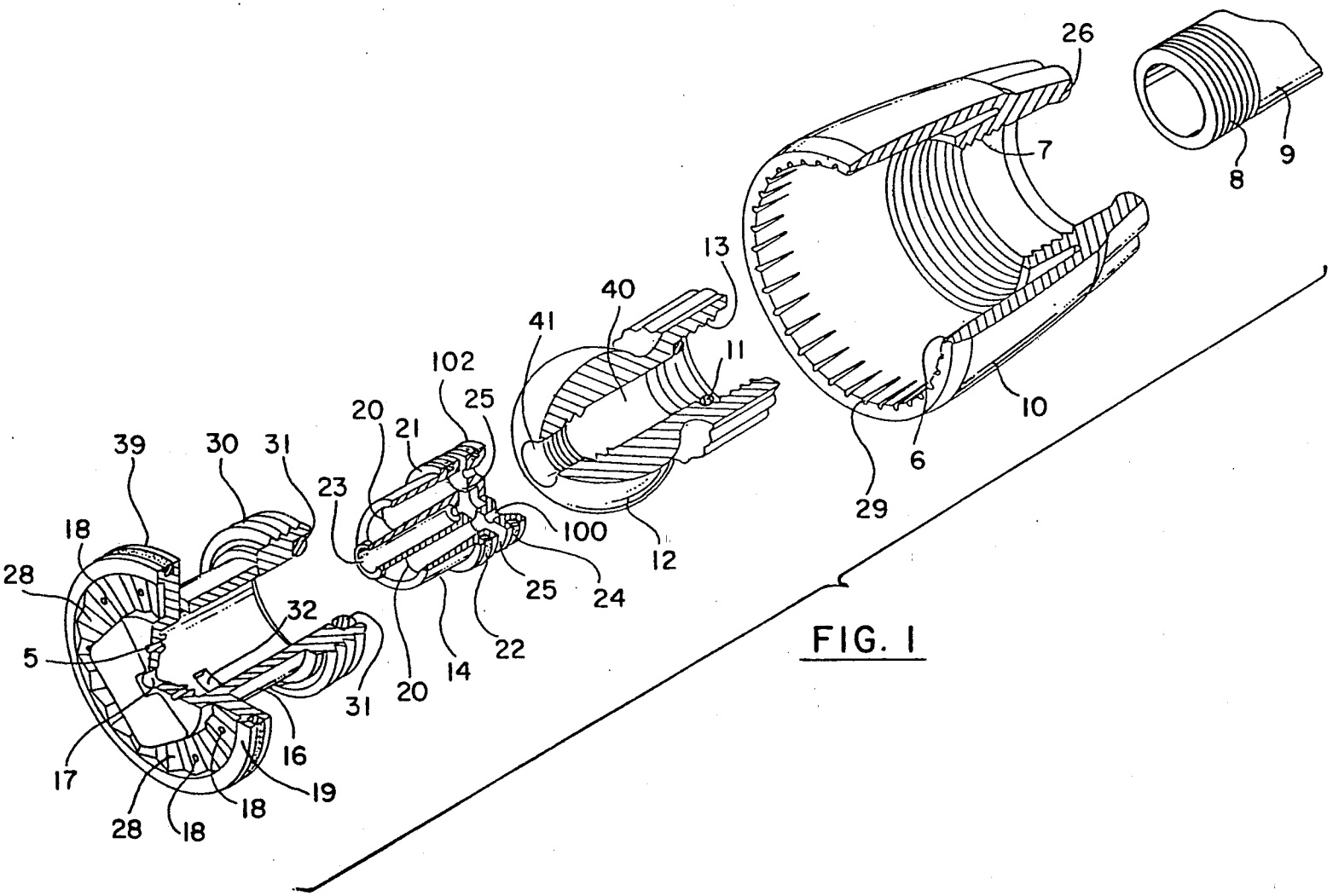
FIG. 1 shows an exploded partial cross-sectional view of the showerhead flow booster of the present invention.
Figures 2, 3:
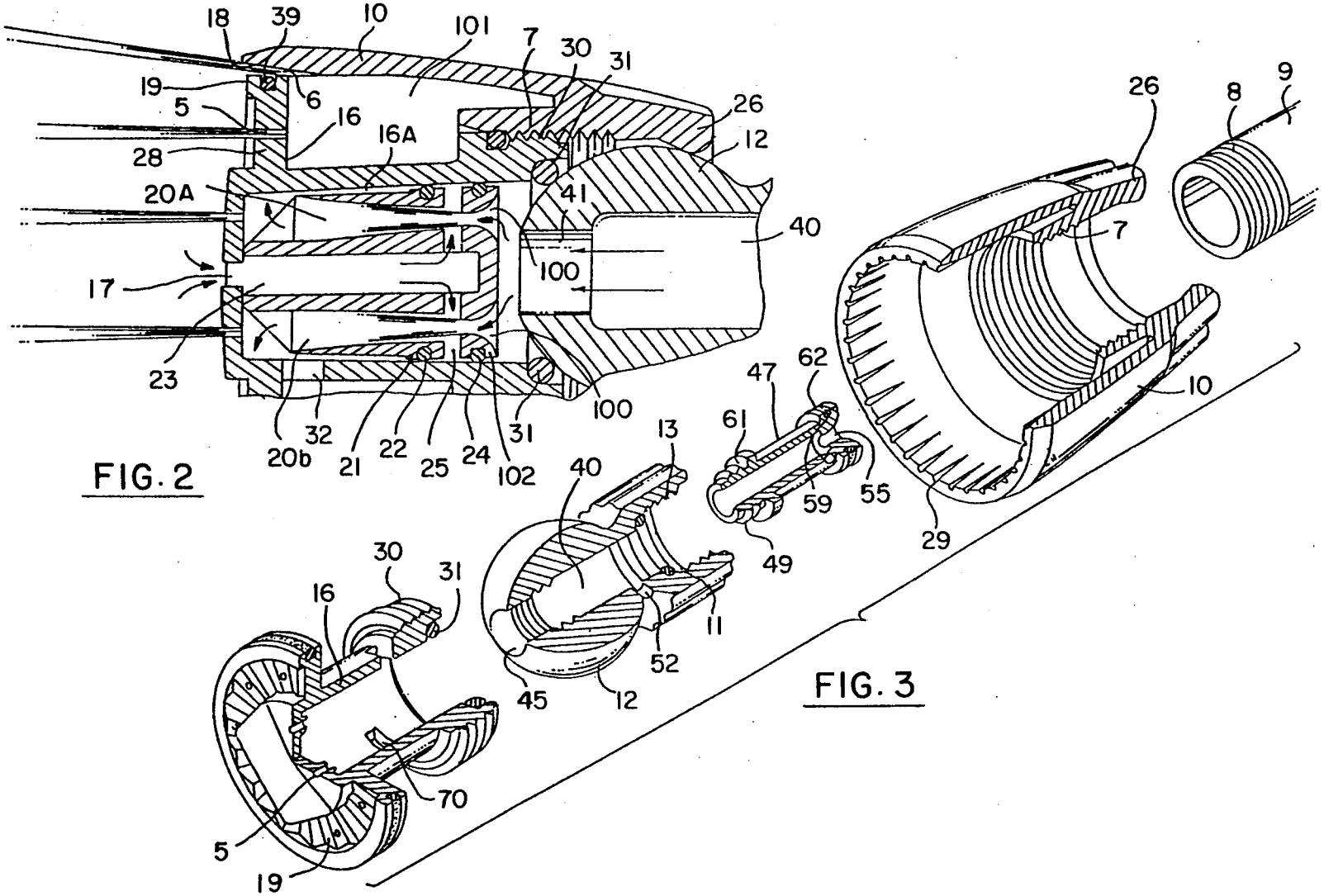
FIG. 2 shows a cross-sectional side view thereof.
FIG. 3 shows a partial cross-sectional view of a second embodiment of the invented showerhead flow booster.

In FIG. 1 there is shown an exploded partial cut away view of the first embodiment of the present invention. In FIG. 2 there is shown a cross-sectional side view thereof. The invented showerhead comprises a housing portion 10 having an internally threaded area 7 at one end and peripheral U-shaped channels 29, at the other end thereof, for forming an outer peripheral spray of water jets. The housing 10 has a rearward tapering flange portion 26 which, when assembled as shown in the cross-sectional view of FIG. 2, is pivotally disposed about and abutting the rearward region of a swivel ball 12. The swivel ball 12 has an interior threaded portion 13 which is adapted to be threaded by engaging with a threaded neck portion 8 of a water output source 9 and is held in sealing contact therewith by virtue of an O-ring 11 of the swivel ball 12. Swivel ball 12 has a central water channel 40 having an output port 41 which, when installed, is in fluid communication with the water source 9.

An internal threaded area 7 of the housing 10 is adapted to threadably engage a central body portion 16 by virtue of mating threads 30 thereof to thereby secure the central body portion 16 within the outer housing 10 such that a lip 19 of a front plate portion 28 is flush with forward edge 6 of the outer housing 10, as shown in FIG. 2. O-ring 39 of front plate portion 28, when the showerhead is assembled, abuts against the forward edge 6 of the outer housing 10 such that an outer peripheral array of water jet ports are created at peripheral U-shaped channels 29. Front plate portion 28 also has a central array of water jet ports 5 as well as an inner array of water jet ports 18. In operation, ports 29, 18 and 5 provide an effective spray pattern.

Central body portion 16, when assembled, abuts against the curved outer portion of the swivel ball 12 and is in pivotal contact therewith by virtue of an O-ring 31. Central body portion 16 has an inner region **16*a* which has two ports 32 for fluid communication to the area outside the inner region 16*a*** and which will later be discussed in more detail.

An important aspect of the present invention is the flow booster 14, which, when assembled, is disposed within the inner region **16*a* of central body portion 16 in between the front plate 28 and the port portion 41 of swivel ball 12. The flow booster 14 has a pair of flanges 21 and 102, each of which have channels adapted for seating O-rings 22 and 24. Flanges 21 and 102 create a circumferential channel 25 which is in fluid communication with a central air/water channel 23 and mixing chambers 20 that will later be discussed in more detail. When assembled, flanges 21 and 102 and O-rings 22 and 24 are in abutting and sealing contact with the inner central region 16*a* of body portion 16 as shown in FIG. 2**.

Flow booster 14 is comprised of a plurality of air and water channels which serve two important functions. Firstly, flow booster 14 increases the velocity of the water inputted thereto by swivel ball 12. Secondly, flow booster 14 mixes the water with ambient air thereby creating turbulent jets comprised of a mixture of air and water which increases the effectiveness of the spray without increasing the volumetric flow rate of the water.

The above mentioned functions are accomplished in the preferred embodiment by four booster chambers 20. Chambers 20A and 20B (the upper and lower chambers) are shown in FIG. 2. Each of the mixing chambers 20 has a corresponding funnel-shaped input port 100. Disposed axially and centrally within the flow booster 14 is the central air/water chamber 23 which, when assembled within the showerhead, is in abutting contact with an air input port 17 of the front plate 28. Central air/water chamber 23 is in fluid communication with the four mixing chambers 20 by virtue of the circumferential channel 25. When installed, central body portion 16 in combination with outer housing portion 10 creates an inner circumferential chamber 101 as shown in FIG. 2. Inner circumferential chamber 101 is in fluid communication with central region **16*a* by virtue of ports 32**.

With reference to FIG. 2, when in operation water flowing outwardly from swivel ball 12 is forced into the input ports 100 of the mixing chambers 20. Since these input ports have a funnel shape, the water is forced through the venturi type openings of the input ports 100 at the water input end toward the restricted rearward end thereof Further, air entering through central port 17 into channel 23 exits therefrom at circumferential channel 25, which is in fluid communication with the four mixing chambers 20 that surround the central chamber 23. Mixing chambers 20 are in fluid communication with circumferential chamber 101 by virtue of ports 32 of the inner housing portion 16.

Velocity of water entering the funnel shaped input ports of mixing chambers 20 creates a negative pressure at central channel 23 which continuously draws ambient air through air input port 17, which consequently mixes with the water in chambers 20, resulting in an outspray which is a combination of air and water having a higher velocity at the given flow rate. In actual practice, it has been found that the present invention increases the flow velocity of water up to 30% and in turn improves the spray pattern of the showerhead.

Figure 4:
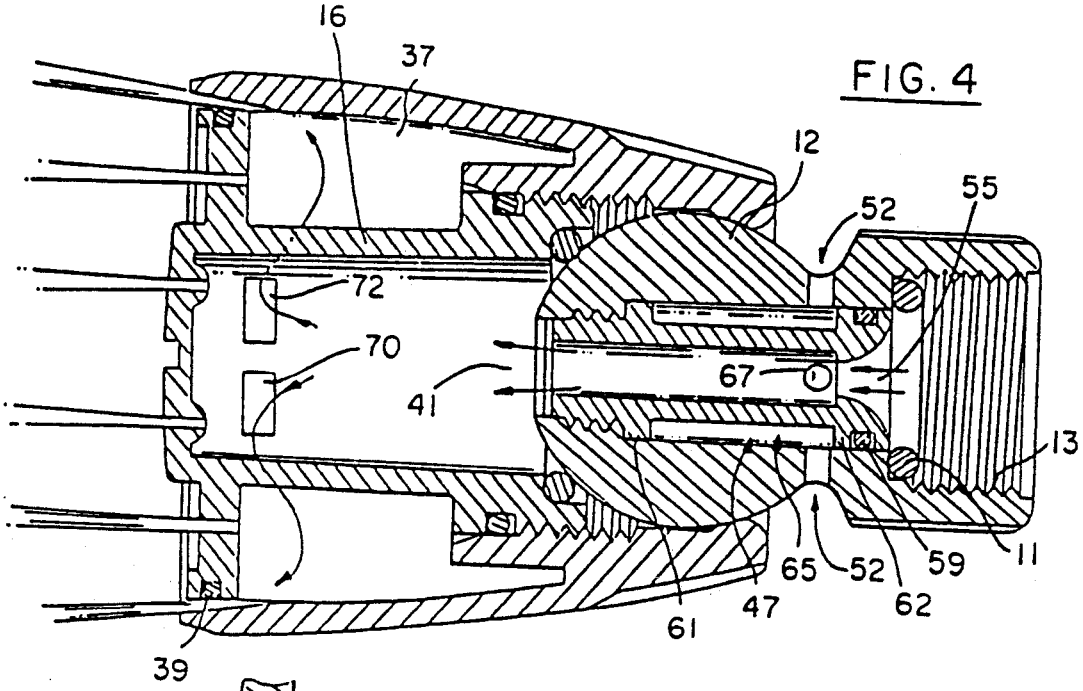
FIG. 4 shows a cross-sectional view thereof.

In FIG. 3, a second embodiment of the present invention is shown. FIG. 4 shows a cross-sectional side view of the second embodiment of the present invention shown in FIG. 3. A description of the operation of the second embodiment of the present invention will be made with reference to FIGS. 3 and 4. In FIGS. 3 and 4, similar elements are denoted by the same reference numerals as in FIGS. 1 and 2 excepting that the flow booster of the second embodiment will be denoted by reference numeral 47.

The flow booster 47 of the second embodiment of the present invention is adapted to fit within the interior of the swivel ball 12. The swivel ball 12 has a threaded neck portion 45 at the forward end of the water channel 40 adjacent water output port 41. Similarly, the flow booster 47 has a threaded forward end portion 49 which is adapted to threadably engage with threaded neck portion 45 of the swivel ball 12. When installed, as shown in FIG. 4, the forward end of the flow booster 47 is completely disposed within the swivel ball 12.

Booster 47 has a tapered funnel shaped input port 55. Water outflowing from water source 9 into the collar portion of the swivel ball 12 is forced into the restricted funnel shaped opening 55 of the booster 47. As with the first embodiment, the difference in size between the rearward portion of the funnel shaped opening and the forward restricted portion thereof creates an increase in the velocity of the water traveling therethrough. The booster 47 also has a pair of air supply apertures 67.

Booster 47 also has a pair of circumferential flanges 61 and 62 which are adapted to be in abutting contact with, respectively, the forward and the rearward portions of the chamber 40 of the swivel ball 12. Flange 62 has an O-ring 59 disposed therein for forming a sealing contact with the rearward end of the bulb channel 40. When assembled as shown in FIG. 4, circumferential flanges 61 and 62 form a central chamber 65. The ball portion 12 of FIGS. 3 and 4 has two air input ports which are in fluid communication with corresponding input ports 67 of the booster 47. Ambient air enters the central chamber 65, through the bulb air ports and is drawn into booster port 67. The aforementioned change in water velocity at the input port 55 of the booster 47 creates a negative pressure which continuously draws the ambient air present in chamber 65 through the air input ports 52 of the ball 12, thereby continuously mixing the water inputted to the flow booster 47 with air. In the embodiment shown in FIGS. 3 and 4, the inner housing portion 16 creates an inner chamber having two output ports 70 and 72 which are in fluid communication with an outer peripheral chamber 37, which fills the same with a mixture of water and air such that a constant output of mixed air and water is outputted from the jets of the showerhead, thereby greatly increasing the effectiveness and efficiency of the spray pattern at flow rates of 3 gallons per minute.

Figure 5:
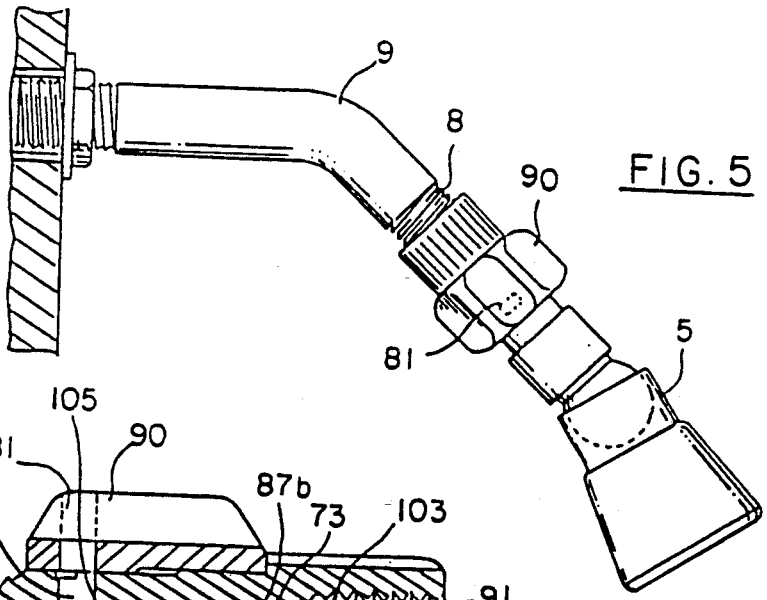
FIG. 5 shows a left side elevational view of a third embodiment of the present invention installed in a typical prior art showerhead.
Figure 6:
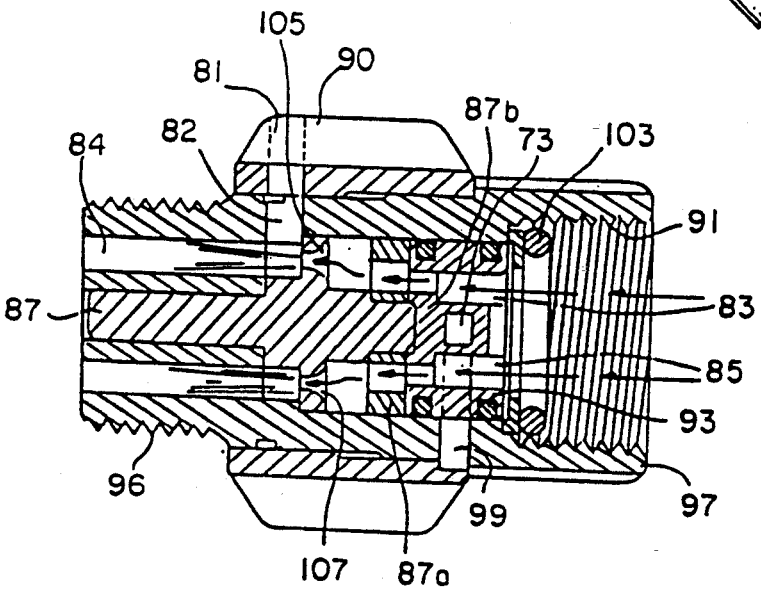
FIG. 6 shows a cross-sectional side view of the third embodiment of the present invention.

In FIG. 5, a right side elevational view of a third embodiment of the present invention adapted for installation in prior art showerheads (termed herein as an "adapter booster") is shown. FIG. 6 shows a cross-sectional side view thereof. The adapter booster will be described with reference to FIGS. 5 and 6.

The third embodiment of the present invention is designed to be installed in typical prior art showerheads in between the water outlet source 9 and the prior art showerhead 5.

The third embodiment of the present invention operates in a manner very similar to the first two embodiments. Specifically, when air inlet port 81 is aligned with air channel 82, water flowing through funnel shaped input ports 105 and 107 increases in velocity and continuously draws air from channel 81 thereby providing a turbulent mixture of air and water.

The adapter booster also provides a water shut-off valve which allows a user to shut the water off at the water outlet source 9 without using the faucet shut-off valve. The adapter booster has, as shown in FIG. 6, a housing portion 97 about which is disposed a rotatable collar portion 90. Collar portion 90 has disposed therein an air inlet port 81, which, when aligned with an air inlet channel 82 of the housing 97, allows the passage of ambient air into an interior circumferential water chamber 84. As shown in FIG. 6, circumferential water chamber 84 extends about the center portion **97*a* of the housing portion 97. Disposed within housing portion 97 is a booster 87** which is similar to the booster of the first two embodiments.

The adapter booster has a rearward inner threaded base portion 91 which is adapted to threadably engage a threaded stem 8 of a water supply source 9. The adapter booster also has a threaded neck portion 96 which is adapted to receive a collar portion of a typical prior art showerhead. As with the collar portion of the first two embodiments, the adapter booster has a collar portion and an O-ring 103 which, when installed upon a water outlet source 9, creates a sealing contact against the threaded stem portion 8. Water entering through the threaded collar region 91 enters into channels 83 and 85. Channels 83 and 85 are oppositely disposed at approximately 180°. Housing portion 97 also has disposed at the lower rearward region thereof a circumferential slot 99 occupying approximately 90° along an axis which is perpendicular to the longitudinal axis of the housing portion 97. Disposed within this slot is an elongate member 93 which is coupled to the booster 87. Rotation of the collar 90 also rotates the elongate member 93 within the circumferential slot which, in turn, rotates the flow booster 87. Booster 87 includes coaxial sections, 87*a* and 87*b*. Section 87*b* rotates within the housing portion 97 in response to rotation of the collar portion 90. Rotation of section 87*b* causes the channels 83 and 85 to rotate out of alignment with the funnel shaped input ports 105 and 107 of flow booster 87, thereby effectively shutting off the flow of water. In this manner, the third embodiment of the present invention provides an auxiliary water shut-off valve while also providing the afore discussed superior functions of the first two embodiments.

It will also be appreciated that the above-described invention may be embodied in other specific forms without departing from the spirit or essential characteristics thereof. The present embodiments are, therefore, to be considered in all aspects as illustrative and not restrictive, the scope of the invention being indicated by the appended claims rather than by the foregoing description, and all changes which come within the meaning and range of equivalency are, therefore, intended to be embraced therein.

I claim:

1. An apparatus for boosting the flow of water, comprising:

an outer housing portion;

means attachable to a water conduit for supplying water to the apparatus from a water supply source;

a support member having at least a portion thereof mounted within the outer housing portion;

a front plate portion adapted to sealably engage said outer housing portion, said front plate portion having a plurality of apertures therethrough for providing a plurality of jet sprays;

the support member having an air inlet port therethrough for providing ambient air, and flow booster means supported within the support member, the flow booster means comprising:

an air chamber in fluid communication with said air inlet port for receiving said ambient air;

a passageway for receiving said water from said water conduit and directing said water towards said plurality of apertures;

the passageway formed with an entry port for receipt of the water from said water conduit, an intermediate port and an exit port form which the water is directed toward said plurality of apertures;

a portion of the passageway tapering inwardly from said entry port to said intermediate port such that the velocity of the water passing from the entry port to the intermediate port is increased;

the portion of the passageway between the entry port and the intermediate port is formed with a funnel shaped wall having a larger funnel opening at the entry port and a smaller funnel opening at the intermediate port, and at least a portion of the passageway between the intermediate port and the exit port forming a mixing chamber in fluid communication through an air inlet opening with said air chamber such that the water of increased velocity passing from the intermediate port into said mixing chamber is mixed with air from said air chamber to provide a turbulent mixture of air and water.

2. The apparatus as set forth in claim 1 wherein the support member is mounted within the outer housing portion for relative movement therebetween.

3. The apparatus as set forth in claim 1 wherein the portion of the support member which is mounted within the outer housing portion is formed externally in a spherical shape so that the support member portion an be swivelled relative to the outer housing portion.

4. The apparatus as set forth in claim 1 wherein the funnel shaped wall is formed in a convex curvature from the entry port to the intermediate port.

5. The apparatus as set forth in claim 1 wherein the passageway is substantially cylindrical between the intermediate port and the exit port.

6. The apparatus as set forth in claim 1 wherein the air inlet opening is in communication with the passageway adjacent the intermediate port and between the intermediate port and the exit port.

7. The apparatus as set forth in claim 1 wherein the support member is formed with an outer wall having the air inlet port formed therethrough and the periphery of the flow booster means is formed with an outwardly facing cavity adjacent the air inlet opening and in communication therewith and wherein the outer wall covers the outwardly facing cavity to form the air chamber.

8. The apparatus as set forth in claim 5 wherein the intermediate port is circular and has a first diameter and the cylindrical portion of the passageway between the intermediate port and the exit port is has a second diameter greater than the first diameter.

9. The apparatus as set forth in claim 1, further comprising a first collection chamber formed within the outer housing portion between the exit port and the plurality of apertures and into which the water from the passageway is deposited to dispense through the plurality of apertures and thereby provides the plurality of jet sprays.

10. The apparatus as set forth in claim 9, wherein the apparatus further comprises at least a second collection chamber in fluid communication with the first collection chamber and in fluid communication with at least one of the plurality of apertures whereby at least a portion of the water in the first collection chamber is deposited into the second collection chamber and dispensed through at least one of the plurality of apertures to thereby provide at least one of the plurality of jet sprays through the at least one of the plurality of apertures.

11. An apparatus for boosting the flow of water, comprising:

a housing formed with a central opening extending therethrough form a rear end to a front end thereof;

the housing including a front face having spaced apertures formed therethrough with the face being located to cover the central opening at the front end of the housing;

a swivel member having a front end and a rear end and at least portions thereof captured within the central opening of the housing adjacent the rear end thereof for relative swivelling movement therebetween;

the swivel member being formed therethrough with central opening from the rear end to the front end and including an interior wall along at least a portion of the central opening of the swivel member;

an ambient air passage formed in the swivel member from and through a peripheral surface of the swivel member to and through the interior wall of the swivel member;

a flow booster element having a central passageway formed therethrough from a rear end to a forward end thereof;

the central passageway formed with an entry port at the rear end of the flow booster element and an exit port at the forward end of the flow booster element;

the central passageway further formed with an intermediate port located between the entry port and the exit port;

the central passageway formed with a funnel shaped interior wall such that the wall tapers inwardly form a larger funnel opening at the entry port to a smaller funnel opening at the intermediate port;

the flow booster element formed with a cavity in the periphery thereof and with at lest one communicating passage between the cavity and the portion of the central passageway between the intermediate port and the exit port;

the flow booster element being located within the central opening of the swivel member whereby the inner wall of the central opening and the cavity of the flow booster element form an air chamber and wherein ambient air is supplied to the air chamber through the ambient air passage of the swivel member and, in turn, through the communicating passage from the air chamber to the central passageway between the intermediate port and the exit port, and means attachable to a water conduit for supplying water from a water supply source to the apparatus where velocity of the water flowing from the entry port to the intermediate port is increased and is then mixed with air between the intermediate port and the exit port to provide a turbulent mixture of air and water.

12. The apparatus as set forth in claim 11, wherein at least the portion of the swivel member which is captured within the central opening of the housing is formed with a spherical peripheral surface to facilitate the relative swivel movement between the housing and the swivel member.

13. The apparatus as set forth in claim 11, wherein the funnel shaped interior wall of the central passageway of the flow booster forms a convex curve from the entry port to the intermediate port.

14. The apparatus as set forth in claim 11, wherein the air chamber forms a cylindrical space which encompasses, but is separated form, a portion of the central passageway from the intermediate port towards the exit port.

15. The apparatus as set forth in claim 11, wherein the communicating passageway of the flow booster element is formed between the air chamber and the central passageway adjacent the intermediate port and between the intermediate port and the exit port.

16. The apparatus as set forth in claim 11, further comprising a first collection chamber formed within the housing between the exit port and the plurality of apertures and into which the water from the passageway is deposited to dispense through the plurality of apertures and thereby provide the plurality of jet sprays.

17. The apparatus as set forth in claim 16, wherein the apparatus further comprises at least a second collection chamber formed within the housing and in fluid communication with the first collection chamber and in fluid communication with at least one of the plurality of apertures whereby at least a portion of the water in the first collection chamber is deposited into the second collection chamber and dispensed through at least one of the plurality of apertures to thereby provide at least one of the plurality of jet sprays through the at least one of the plurality of apertures.

18. An apparatus for boosting the flow of water, comprising:

an outer housing portion;

means attachable to a water conduit for supplying water to the apparatus from a water supply source;

a support member having at least a portion thereof mounted within the outer housing portion;

a front plate portion adapted to sealably engage said outer housing portion, said front plate portion having a plurality of apertures therethrough for providing a plurality of jet sprays;

the support member formed with an outer wall having an air inlet port therethrough for providing ambient air, and flow booster means supported within the support member, the flow booster means comprising:

an air chamber in fluid communication with said air inlet port for receiving said ambient air;

a passageway for receiving said water form said water conduit and directing said water towards said plurality of apertures;

the passageway formed with an entry port for receipt of the water from said water conduit, an intermediate port and an exit port from which the water is directed toward said plurality of apertures;

the passageway tapering inwardly from said entry port to said intermediate port such that the velocity of the water passing from the entry port to the intermediate port is increased;

at least a portion of the passageway between the intermediate port and the exit port forming a mixing chamber in fluid communication through an air inlet opening with said air chamber such that the water of increased velocity passing from the intermediate port into said mixing chamber is mixed with air form said air chamber to provide a turbulent mixture of air and water, and the periphery of the flow booster means is formed with an outwardly facing cavity adjacent the air inlet opening and is in communication therewith wherein the outer wall covers the outwardly facing cavity to form the air chamber.

19. An apparatus for boosting the flow of water, comprising:

an outer housing portion;

means attachable to a water conduit for supplying water to the apparatus from a water supply source;

a support member having at least a portion thereof mounted within the outer housing portion;

a front plate portion adapted to sealably engage said outer housing portion, said front plate portion having a plurality of apertures therethrough for providing a plurality of jet sprays;

the support member having an air inlet port therethrough for providing ambient air, and flow booster means supported within the support member, the flow booster means comprising:

an air chamber in fluid communication with said air inlet port for receiving said ambient air;

a passageway for receiving said water from said water conduit and directing said water towards said plurality of apertures;

the passageway formed with an entry port for receipt of the water from said water conduit, an intermediate port and an exit port form which the water is directed toward said plurality of apertures;

the intermediate port is circular and has first diameter;

the passageway tapering inwardly from said entry port to said intermediate port such that the velocity of the water passing from the entry port to the intermediate port is increased;

the passageway is substantially cylindrical between the intermediate port and the exit port and has a second diameter greater than the first diameter; and at least a portion of the passageway between the intermediate port and the exit port forming a mixing chamber in fluid communication through an air inlet opening with said air chamber such that the water of increased velocity passing from the intermediate port into said mixing chamber is mixed with air form said air chamber to provide a turbulent mixture of air and water.

20. An apparatus for boosting the flow of water, comprising:

an outer housing portion;

means attachable to a water conduit for supplying water to the apparatus from a water supply source;

a support member having at least a portion thereof mounted within the outer housing portion;

a front plate portion adapted to sealably engage said outer housing portion, said front plate portion having a plurality of apertures therethrough for providing a plurality of jet sprays;

the support member having an air inlet port therethrough for providing ambient air, and flow booster means supported within the support member, the flow booster means comprising:

an air chamber in fluid communication with said air inlet port for receiving said ambient air;

a passageway for receiving said water from said water conduit and directing said water towards said plurality of apertures;

the passageway formed with an entry port for receipt of the water from said water conduit, an intermediate port and an exit port from which the water is directed toward said plurality of apertures;

the passageway tapering inwardly from said entry port to said intermediate port such that the velocity of the water passing form the entry port to the intermediate port is increased;

at least a portion of the passageway between the intermediate port and the exit port being unobstructed and of uniform cross-section and forming a mixing chamber in fluid communication through an air inlet opening with said air chamber such that the water of increased velocity passing from the intermediate port into said mixing chamber is mixed with air from said air chamber to provide a turbulent mixture of air and water; and a collection chamber formed within the outer housing portion between the exit port and the plurality of apertures and into which the water from the passageway is deposited to dispense through the plurality of apertures and thereby provides the plurality of jet sprays.

* * * * *